United States Patent [19]

Bolding, Jr.

[11] 4,286,659

[45] Sep. 1, 1981

[54] BALL VALVE SAFETY SCREEN

[75] Inventor: Benson H. Bolding, Jr., St. Martinville, La.

[73] Assignee: Aztec Tools, Inc., Lafayette, La.

[21] Appl. No.: 70,430

[22] Filed: Aug. 28, 1979

[51] Int. Cl.[3] ..... E21B 43/08

[52] U.S. Cl. ..... 166/205; 166/328; 210/451; 175/318

[58] Field of Search ..... 166/328, 205, 157; 175/318; 137/550; 210/451, 452, 454

[56] References Cited

U.S. PATENT DOCUMENTS

| | | | |
|---|---|---|---|
| 1,270,274 | 6/1918 | Dunn | 210/451 |
| 1,859,648 | 5/1932 | Baker | 166/328 X |
| 2,153,034 | 4/1939 | Baker | 166/328 X |
| 2,217,203 | 10/1940 | Hill | 175/318 X |
| 2,654,097 | 10/1953 | Epstein | 210/451 X |
| 3,314,481 | 4/1967 | Willman et al. | 166/228 X |

*Primary Examiner*—William F. Pate, III
*Attorney, Agent, or Firm*—Guy E. Matthews

[57] ABSTRACT

A device for preventing unwanted objects from entering the ball assembly of a float collar or float shoe and otherwise damaging or plugging the valve mechanism therein is disclosed. The device comprises a screen constructed of expanded metal and rigidly affixed to the interior of the float collar or float shoe above the ball valve assembly. The screen portion is either mounted to the interior surface of the float collar sleeve by an annular structural member or mounted to a structural band which is partially embedded in the concrete portion of the float collar or casing guide shoe.

4 Claims, 3 Drawing Figures

BALL VALVE SAFETY SCREEN

FIELD OF THE INVENTION

This invention relates generally to casing float collars, float shoes and float-type casing guide shoes, and more specifically to a screen device acting as a filter for screening drilling mud and casing cement prior to passing through the casing float collar or float shoe to prevent unwanted objects contained in the fluid from damaging or plugging the ball or flapper valves within the ball valve assemblies.

Casing float collars and float shoes are well known in the art and are used extensively in casing running and cementing operations in the downhole wellbore. After a well is drilled to below the oil production layer, or strata, what is termed "production casing" is run down inside the wellbore to the bottom. Initially, the wellbore is typically filled with a mixture of water, oil, drilling mud, etc. It is desired that this fluid mixture not enter the production casing as the casing is lowered and positioned within the wellbore. To effect this, a guide shoe or float shoe is attached to the first length of casing to be lowered into the wellbore. This guide shoe or float shoe has a rounded nose to guide the casing around obstructions, ledges, etc. within the wellbore. Some guide shoes or float shoes are equipped with a float valve device that closes under pressure from within the wellbore to prevent the casing from filling with this fluid mixture as the casing is dropped down into the wellbore. Occasionally, combination float collars and guide shoes are used as multi-stage back pressure valves to more effectively perform the desired function.

With the casing in place at the bottom of the wellbore, the next step is to permanently attach it to the hole interior. This is accomplished by filling the annular space between the wellbore and casing with cement, the primary functions of which are:

(1) to restrict fluid movement between formations and to the surface;

(2) to provide support for the casing;

(3) to prevent pollution of fresh water formations; and (4) to prevent casing corrosion.

Cement is placed within this annular space by pumping the cement down inside the casing, through the system of float collars and float shoes, out the bottom of the casing and then back up the annular space between the casing and wellbore. Thus, primary functions of the float collar and float shoe are to preclude the entry of the fluid mixture originally in the wellbore from entering the casing and diluting or otherwise contaminating the casing cement introduced at the top of the casing string, preventing a possible blowout through the casing, and provide a means of floating a portion of the casing to bottom of deep wellbores.

Heretofore, float collar ball valve assemblies have been susceptible to damage or clogging by foreign objects contained within the casing cement or drilling mud as the fluid is pumped through the float collar or float shoe. A more severe problem exists, however, when foreign objects contained within the liquid plug or otherwise restrict the internal fluid passageway of the float collar, which, in turn causes an abortion of the casing cementing operation and a substantial loss in terms of man-time and machine-time, not to mention the sizable dollar loss incurred.

It is therefore an object of the present invention to provide a screen device for preventing foreign objects contained within drilling mud or casing cement from entering and damaging the valve mechanism of a casing float collar ball valve assembly or float shoe assembly.

It is a further object of the present invention to provide a device that prevents foreign objects from entering the casing float collar and plugging or restricting flow through the internal flow channel therein.

It is a further object of the present invention to provide a device for dispersing clotted matter contained in drilling mud or casing cement to allow same to pass through a casing float collar ball valve assembly.

It is a further object of the present invention to provide a flat surface upon which cementing plugs seat.

SUMMARY OF THE INVENTION

The present invention is directed to a screen device for use with a casing float collar or float shoe to prevent unwanted objects from passing through the valve mechanism of the ball valve assembly therein. The device comprises a top portion, constructed of expanded metal and a sidewall portion connected thereto and depending therefrom, constructed of a metal band having perforations therein through which drilling mud or casing cement passes. The sidewall portion is embedded into the concrete portion of the float collar or float shoe, forming a structurally rigid part thereof.

BRIEF DESCRIPTION OF THE DRAWINGS

The features and advantages of this invention will become more apparent of those skilled in the art from the following detailed description of the invention together with the drawings in which.

DETAILED DESCRIPTION OF THE INVENTION

Figure 2:
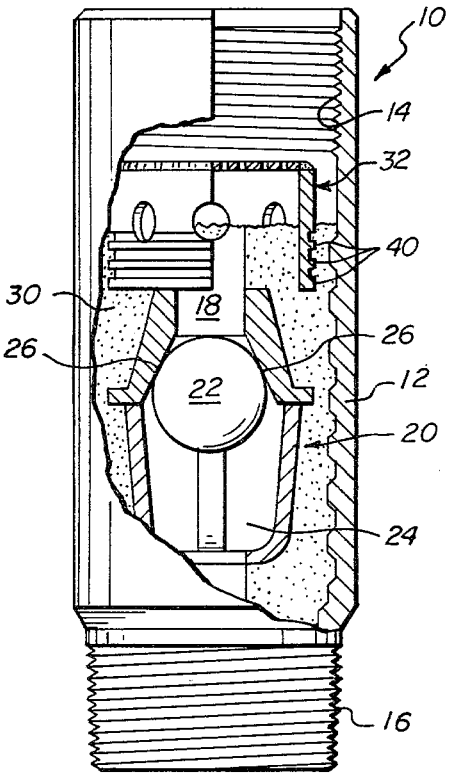
FIG. 2 is a vertical sectional view of a casing float collar incorporating the ball valve safety screen.

Turning now to the drawings, and more particularly to FIG. 2, a float collar is shown generally illustrated at 10. The float collar 10 comprises a main body portion 12, said body portion including internal threads at its upper end for threadedly engaging a section of pipe, and external threads 16 at the lower end thereof, likewise for threadedly engaging a section of pipe. An internal flow channel or passage 18 is located vertically within the float collar 10 in order that drilling mud, casing cement or other fluid may flow through the collar. A ball valve assembly 20 is positioned approximately midway through this flow channel 18 for regulating the flow of fluid in either direction through the float collar 10. The ball valve assembly 20 comprises a ball valve or float valve 22 suspended within a chamber 24 of the assembly. The ball valve 22 acts against an upper seat 26 to restrict or preclude flow of fluid through the internal flow chamber 18 in an upperward direction, in response to differential fluid pressure above and below the ball valve assembly. This seat 26, is conical shaped and may be made of neoprene or other material suitable to withstand the corrosive effects of drilling mud and casing cement, yet retain its resiliency and positive sealing capability. The ball valve assembly 20 is set in float collar internal cement 30 to permanently mount it within the float collar 10.

Figure 1:
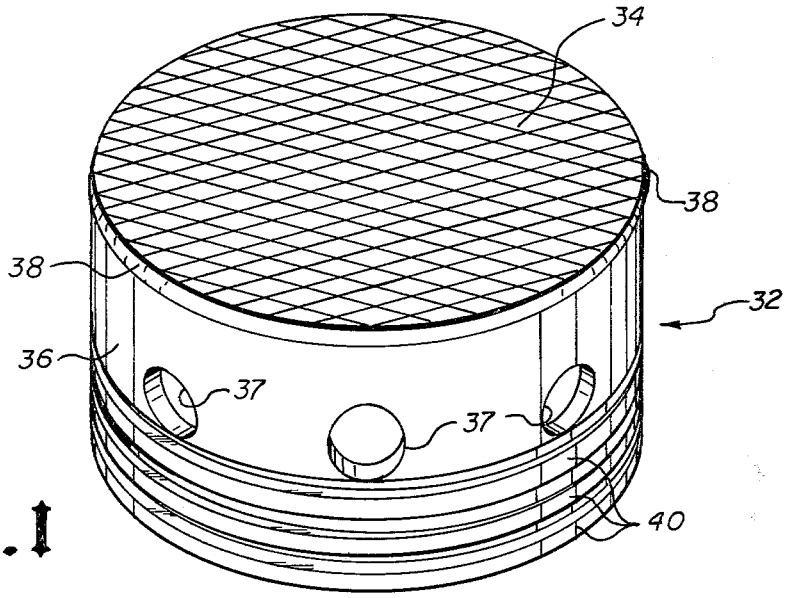
FIG. 1 is a pictorial view of the preferred embodiment of the ball valve safety screen.

As shown in FIG. 1, a preferred embodiment of the ball valve safety screen device 32 is shown comprising a screen portion 34 and a sidewall portion 36 depending vertically therefrom. In this preferred embodiment, the screen portion 34 is constructed of expanded metal defining a plurality of openings therein to provide maximum flow through area while retaining improved structural characteristics. The expanded metal screen portion 34 is sufficiently strong to withstand bombardment by undesirable objects, etc. occasionally found in mud and casing cement, yet is porous enough to permit the liquid to freely pass therethrough with no appreciable reduction in flow rate. The screen portion 34 is also sufficiently large so as not to affect the flow rate therethrough even when the screen portion 34 is partially blocked by accumulated undesirable objects such as rags, gloves, dope brushes, nuts, bolts, clotted cement, rust particles from used casings, silt and other foreign matter.

The sidewall portion 36 comprises a metal ring or band with optional perforations 37 therein for permitting fluid to flow therethrough yet retaining maximum structural stability. The screen portion 34 and sidewall portion 36 are welded together at 38 to form a rigid, structurally stable screen device.

As best shown in FIG. 2, the safety screen device sidewall portion 36 is embedded into the float valve internal cement 30 as the float collar, or float shoe 10 is fabricated at the manufacturing facility. Retaining flanges 40 on the sidewall portion 36 serve to retain the screen device 32 in position and prevent same from jarring loose under bombardment impact from the foreign matter that may be present in drilling mud or casing cement. By so doing, additional structural stability is imparted to both the safety screen device 32 and the internal cement portion 30, the safety screen device becoming an integral part thereof.

Figure 3:
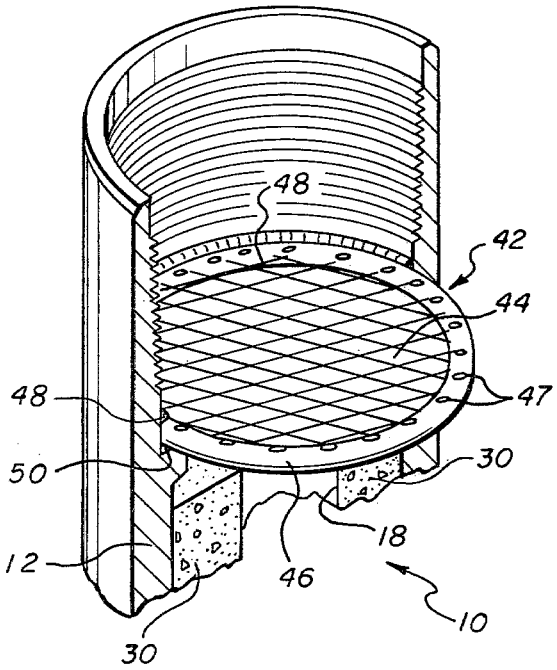
FIG. 3 is a partial pictorial view of a casing float collar incorporating an alternative embodiment of the present invention.

An alternative embodiment 42 of the present invention is shown in FIG. 3, comprising a screen portion 44 constructed of expanded metal, as in the preferred embodiment, but retained in place within the float collar 10 above the ball valve assembly 20 by an annular retaining ring 46 which connects the screen portion to the interior surface of the float collar. As in the sidewall portion 36 of the preferred embodiment, this annular ring 46 may include perforations 47 therein for permitting fluid to flow therethrough yet retaining maximum structural stability. Similarly, the screen device 44 and retaining ring 46 are welded together at 48 to form a rigid, structurally stable screen device. This alternative embodiment 42 may include an annular flange 50 to enable the screen device 42 to be attached to the float collar interior by bolts, screws, welding or other suitable manner.

In operation, a float collar or float shoe 10 is threadedly attached between two sections of casing being lowered into a wellbore. The float valve serves as a back-pressure valve to retain pressure below the valve (outside the casing string) when the valve is in the closed position, thereby preventing outside fluid from entering the casing as the casing is lowered into the wellbore. This outside pressure permits the casing to "float" into the wellbore, depending on the amount of fluid placed inside the casing string as it is filled from the surface (above the ball valve). When the casing has been run to the desired depth, circulation is established through the casing and the float valve by pumping casing cement, for example, down inside the casing string and overcoming the fluid pressure below the ball valve (outside the casing string).

The ball valve in the float collar also serves as a check-valve in the casing string to prevent backflow of cement that has been pumped outside the string through the valve into the annulus between the casing and the wellbore. This check valve feature also serves to prevent a blowout through the casing, in the event high pressure formations are exposed in the open wellbore.

When the casing has been run to the desired depth, casing cement is introduced at the top thereof and pumped down through the string, through the float collar and/or float shoe and into the annulus between the casing string and wellbore in order to set the casing within the wellbore. It is during this operation that the safety screen device 32 is of extreme importance. It serves, first, to preclude large objects, such as rocks clotted cement, rust, gloves, wood, nuts, bolts, rags or other foreign matter occasionally found in mud and cement, from entering and otherwise damaging the ball valve 22 within the assembly 20, and secondly, to break up clotted cement, millscale, rust, rags, wood, etc., occasionally found in mud and cement, permitting same to pass through the float collar or float shoe internal float channel 18 without fear of plugging the channel or damaging the ball valve 22 therein.

The present invention has been described in connection with a casing float collar, used intermediate sections of a casing string. The present invention is equally applicable for use with a float shoe without detracting from the spirit of the invention as set forth in the appended claims.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A float collar for use in well preparation and production of hydrocarbons comprising:

(a) a longitudinal body having a longitudinal passageway therethrough;

(b) a valve assembly positioned in said body, including a float valve positioned in said passageway;

(c) and screen means mounted above said valve assembly and over said passageway for enabling circulation of fluids such as drilling mud, casing cement and the like through said passageway, said screen means preventing unwanted objects from clogging, stopping or otherwise preventing flow of fluid through said float collar assembly, screen means including a flat circular perforated screen portion positioned substantially perpendicular to said body and extending to cover substantially the entire interior of said body and a cylindrical mounting ring attached to and depending downwardly from the edge of said screen portion, said mounting ring including means for rigidly mounting said mounting ring within said body and said mounting ring including a plurality of perforations therein for permitting the flow of fluid therethrough.

2. The device as set forth in claim 1, including means for anchoring said circular band into the float collar cement.

3. A screen device rigidly supported with a float collar interior for preventing unwanted objects contained in drilling mud and casing cement from entering the ball valve assembly of the float collar and otherwise damaging the valve therein, at least a portion of said screen device being perforated and defining a plurality of openings through which drilling mud and casing cement is permitted to flow, said openings being sufficiently small to prevent passage of unwanted objects therethrough, said device comprising:

(a) a screen portion having perforations therein to enable fluids to pass therethrough yet prohibit the passage of unwanted solid objects; and (b) a mounting portion attached to and depending from said screen portion for supporting said screen portion in a structurally suitable manner, said mounting portion comprising an annular ring for rigidly connecting said screen portion to the interior tubular portion of the float collar, said annular ring having a plurality of perforations therein for permitting fluid flow therethrough.

4. A screen device for mounting in a float collar for preventing unwanted objects from entering the valve assembly of the float collar, wherein the float collar includes a cylindrical body having an interior and a passageway having the valve assembly therein embedded in cement which comprises:

a flat circular perforated screen portion having a diameter substantially as large as the interior of said body;

and means for mounting said screen portion within said float collar having a circular band containing a plurality of perforations for permitting fluid flow therethrough and for anchoring said circular band into the float collar cement, said circular band being mounted at one edge to said screen portion and a second thereof being adapted to be embedded into the cement within said float collars to support said screen device over the float collar passageway and valve assembly.

* * * * *